US006993792B2

(12) United States Patent
Marty et al.

(10) Patent No.: US 6,993,792 B2
(45) **Date of Patent: *Feb. 7, 2006**

(54) DRAFT BARRIER SYSTEM

(75) Inventors: Justin Douglas Marty, Salt Lake City, UT (US); Joseph Edward Marty, North Salt Lake, UT (US); Joshua Craig Pace, Salt Lake City, UT (US)

(73) Assignee: Z Gear, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/770,143

(22) Filed: Jan. 31, 2004

(65) Prior Publication Data

US 2005/0034206 A1 Feb. 17, 2005

Related U.S. Application Data

(63) Continuation-in-part of application No. 10/665,320, filed on Sep. 20, 2003, and a continuation-in-part of application No. 10/665,344, filed on Sep. 20, 2003, and a continuation-in-part of application No. 10/638,990, filed on Aug. 11, 2003.

(51) Int. Cl.
*A41D 13/00* (2006.01)

(52) U.S. Cl. ..... 2/69

(58) Field of Classification Search ..... 2/93, 2/94, 79, 227, 102, 108, 69, 69.5, DIG. 1, 2/84, 86, 114, 115, 2.17, 243.1, 71, 72, DIG. 2
See application file for complete search history.

(56) References Cited

U.S. PATENT DOCUMENTS

| | | | | |
|---|---|---|---|---|
| 361,250 A | | 4/1887 | Wright | |
| 2,136,879 A | | 11/1938 | Haber et al. | 2/270 |
| 2,178,885 A | | 11/1939 | Buff et al. | 24/205 |
| 2,274,510 A | | 2/1942 | Wohl et al. | 2/270 |
| 2,483,057 A | | 9/1949 | Levering | 24/205 |
| 2,622,248 A | | 12/1952 | Schaye | 2/80 |
| 2,744,253 A | * | 5/1956 | Freedman | 2/80 |
| 2,856,609 A | | 10/1958 | Persico et al. | 2/269 |
| 2,889,605 A | | 6/1959 | Morin | 24/205 |
| 3,170,167 A | | 2/1965 | Isaacs | 2/269 |
| 3,214,771 A | | 11/1965 | Treiber | 2/270 |
| 3,219,084 A | | 11/1965 | Ausnit et al. | 150/3 |
| 3,328,809 A | | 7/1967 | Payne et al. | 2/269 |
| 3,448,463 A | | 6/1969 | Milone | 2/234 |
| 3,726,329 A | | 4/1973 | Dean | 150/28 R |
| 3,771,169 A | * | 11/1973 | Edmund | 2/2.17 |
| 4,112,556 A | | 9/1978 | Flaum et al. | 24/205.1 R |
| 4,149,275 A | | 4/1979 | Sanchez | 2/269 |
| 4,158,892 A | * | 6/1979 | Gonzales | 2/69.5 |
| 4,200,938 A | | 5/1980 | LeTourneau | 2/269 |
| 4,485,534 A | | 12/1984 | Pilie et al. | 24/384 |
| 4,492,006 A | | 1/1985 | Ishii | 24/382 |
| 4,543,670 A | | 10/1985 | Ehring | 2/85 |
| 4,602,389 A | | 7/1986 | Brown | 2/243 R |
| 4,608,715 A | * | 9/1986 | Miller et al. | 2/1 |
| 4,631,753 A | | 12/1986 | Ehring | 2/85 |
| 4,757,577 A | | 7/1988 | Freeman | 24/382 |
| 4,896,379 A | | 1/1990 | Kape | 2/269 |
| 4,985,936 A | | 1/1991 | Jones | 2/269 |
| 5,031,944 A | | 7/1991 | Keyaki | 292/307 R |
| 5,033,127 A | | 7/1991 | Schmeltz | 2/269 |

(Continued)

*Primary Examiner*—Tejash Patel
(74) *Attorney, Agent, or Firm*—Julie H. Gheem; Kirton & McConkie

(57) ABSTRACT

A draft barrier system having a sliding fastener that lets a user selectively alternate a volume of material between open and closed formations. When the sliding fastener closes the volume of material into the closed formation, insulation is compressed together to form a seal that helps prevent air from moving between the interior and the environment through the sliding fastener.

20 Claims, 9 Drawing Sheets

U.S. PATENT DOCUMENTS

| | | | | |
|---|---|---|---|---|
| 5,044,015 | A | 9/1991 | Howard | 2/269 |
| 5,072,454 | A | 12/1991 | Trahan | 2/70 |
| 5,088,128 | A | 2/1992 | Kape | 2/269 |
| 5,153,944 | A | 10/1992 | Teel | 2/243 R |
| 5,170,505 | A | 12/1992 | Rohrer | 2/69 |
| 5,208,920 | A | 5/1993 | Schaefer et al. | 2/269 |
| 5,299,323 | A | 4/1994 | Schaefer et al. | 2/93 |
| 5,490,294 | A | 2/1996 | Kramer | 5/413 |
| 5,535,453 | A | 7/1996 | Howard | 2/269 |
| 5,539,932 | A | 7/1996 | Howard | 2/269 |
| 5,575,010 | A | 11/1996 | Chung | 2/227 |
| 5,608,915 | A | 3/1997 | Libit | 2/228 |
| 5,697,130 | A | 12/1997 | Smith | 24/383 |
| 5,774,892 | A | 7/1998 | Tisdale et al. | 2/69 |
| 5,787,511 | A | 8/1998 | Garside | 2/269 |
| 5,794,265 | A | 9/1998 | Reich | 2/125 |
| 5,815,837 | A | 10/1998 | Christman et al. | 2/158 |
| 5,894,600 | A | 4/1999 | Chenefront | 2/69 |
| 5,953,758 | A | 9/1999 | Foster | 2/268 |
| 6,047,404 | A | 4/2000 | Blanks, I | 2/69 |
| 6,058,578 | A | 5/2000 | Lan | 24/429 |
| 6,076,189 | A | 6/2000 | Christman et al. | 2/158 |
| 6,223,349 | B1 | 5/2001 | Roiser | 2/2.17 |
| 6,253,381 | B1 | 7/2001 | Kelley | 2/125 |
| 6,317,894 | B1 | 11/2001 | Blechman | 2/269 |
| 6,349,413 | B1 | 2/2002 | Rose et al. | 2/126 |
| 6,415,482 | B1 | 7/2002 | Pontaoe | 24/429 |
| 6,742,225 | B2 * | 6/2004 | Marty et al. | 24/382 |
| 2004/0055118 | A1 | 3/2004 | Marty et al. | 24/382 |
| 2004/0128730 | A1 | 7/2004 | Marty et al. | 2/69 |
| 2004/0128731 | A1 | 7/2004 | Marty et al. | 2/69 |

* cited by examiner

DRAFT BARRIER SYSTEM

RELATED APPLICATIONS

This application is a Continuation-in-Part of: (1) U.S. Utility patent application Ser. No. 10/665,320, filed Sep. 20, 2003, titled SYSTEMS AND METHODS FOR TRANSFORMABLE SLEEVES; (2) U.S. Utility patent application Ser. No. 10/665,344, filed Sep. 20, 2003, titled SYSTEMS AND METHODS FOR TRANSFORMABLE SUITS; and (3) U.S. Utility patent application Ser. No. 10/638,990, filed Aug. 11, 2003, titled MULTI-TRACK FASTENING SYSTEM.

BACKGROUND

1. Field of the Invention

The present invention relates generally to systems for providing a barrier to block drafts from entering a volume or compartment of material. More particularly, the present invention relates to a draft barrier system having a fastener that opens and closes the volume of material that it is attached to, the fastener causing the draft barrier system to automatically engage upon closing the volume of material.

2. Background Information

Various methods have been invented to help prevent exterior air from entering a closed volume of material at the point of closure on the volume of material. For example, sleeping bags often have zippers thereon to allow a person using the bag to open and close it, thereby allowing the person to enter and exit the sleeping bag. A typical zipper includes a track or chain having two rows of teeth that interlock with each other. A zipper slider is located on the track so that a user can pull on a pull tab on the zipper slider in order to move the slider up and down the track, thereby causing the zipper to zip open and closed as desired. Some zippers have a stop at one or both ends of the zipper to stop the zipper slider from moving off of the track. Some zippers are designed so that the zipper slider is never removed from the track; other zippers are designed to allow the zipper slider to be removed from one row of the track, thereby allowing the material attached to one row of teeth to be further separated from the material attached to the other row of teeth.

Some zippered sleeping bags further include a flap or other insulating material located near the zipper area. This is intended to prevent the exterior air from entering into the closed sleeping bag through the closed zipper. However, existing draft barriers are inconvenient, unwieldy to use, or simply do not work very well to prevent the exterior air from entering into the closed bag. Many draft barriers, such as those comprising a loose flap of material sewn just inside the zipper, require significant manual manipulation before they are in a position to be effective; even after these barriers have been properly placed, they are nevertheless easily displaced and need frequent re-positioning.

SUMMARY AND OBJECTS OF THE INVENTION

The present invention comprises a draft barrier system having a sliding fastener that lets a user selectively alternate a volume of material between open and closed formations. When the sliding fastener closes the volume of material into the closed formation, insulation is compressed together to form a seal that helps prevent air from moving between the interior and the environment through the sliding fastener. The sliding fastener may have various embodiments. Some embodiments of the sliding fastener have interchangeable matable rows; others have matable rows that do not interchange. A volume of material can comprise many types of items, including sleeping bags and jackets.

Accordingly, it is an object of some embodiments of the present invention to provide a convenient system for preventing drafts of air from entering through a closed fastener.

Another object of some embodiments of the present invention is to provide a draft barrier system that automatically engages upon closing the volume of material to the exterior environment.

Yet another object of some embodiments of the present invention is to provide a system for blocking drafts from entering a sleeping bag through a closed zipper in the sleeping bag.

BRIEF DESCRIPTION OF THE DRAWINGS

The foregoing and other objects and features of the present invention will become more fully apparent from the accompanying drawings when considered in conjunction with the following description and appended claims. Other objects will likewise become apparent from the practice of the invention as set forth hereafter. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

One purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are generally designated by like alphanumeric characters throughout.

Figure 1B:
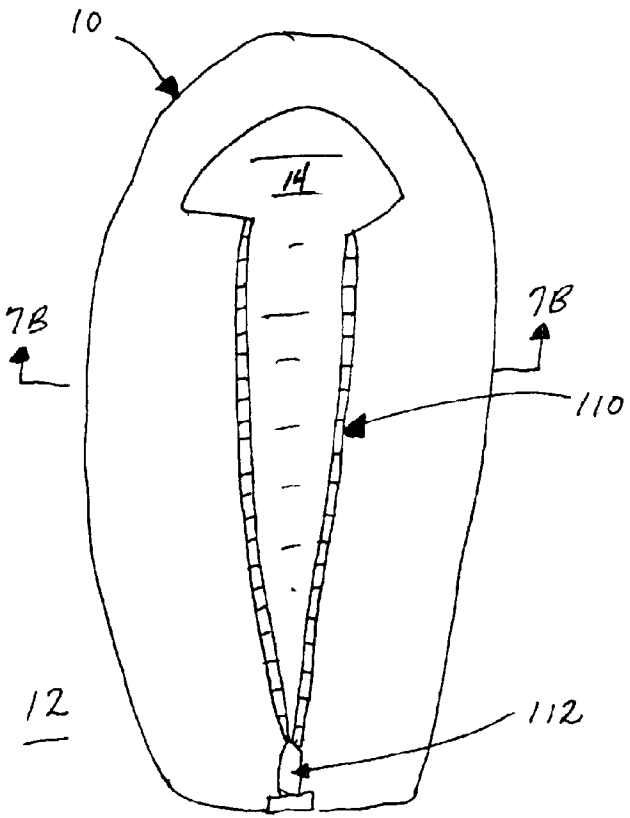
FIGS. 1A and 1B are plan views showing some embodiments of the present invention.
Figure 1A:
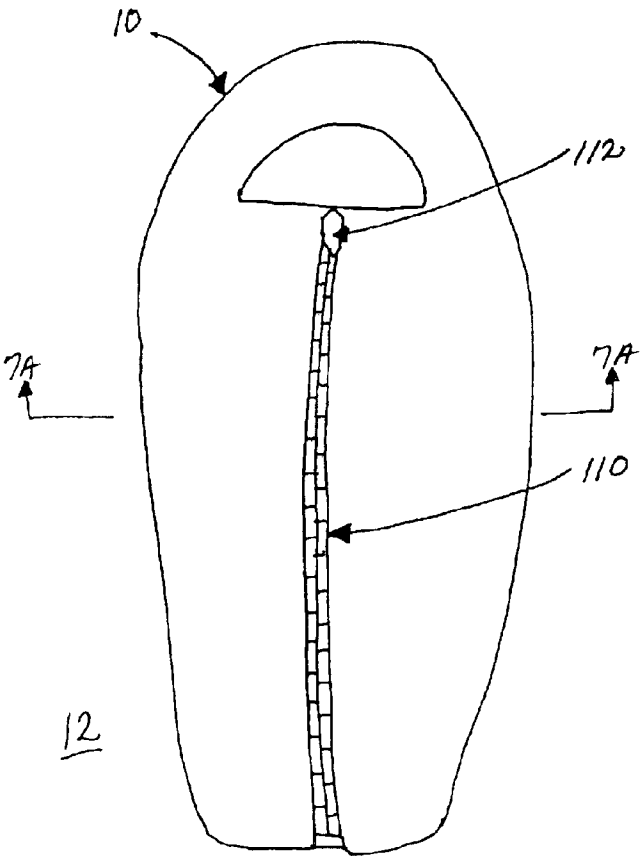

FIGS. 1A and 1B show a volume of material 10 and a sliding fastener 110 incorporated into the volume of material 10 in accordance with some embodiments of the present invention. The volume of material 10 comprises material or fabric and is preferably designed to be worn by a user. For example, the volume of material 10 may comprise a sleeping bag, a jacket, or parka. The volume of material 10 has an interior 14 that can be substantially closed off from an environment 12 exterior to the volume of material 10.

The sliding fastener 110 allows the user to selectively alternate the volume of material 10 between a first closed formation (as can be seen in FIG. 1A) and a second open formation (as can be seen in FIG. 1B). The sliding fastener can have a variety of embodiment, but some of the preferred embodiments will be discussed herein. In the preferred embodiments, the sliding fastener 110 is a zipper-type device and can be used to zip and unzip the volume of material 10 between the top end of the volume of material 10 near the user's head and the bottom end of the volume of material 10 near the user's feet. As such, the sliding fastener 110 can be used to allow a wearer to enter or exit the volume of material 10.

When the user uses the sliding fastener 110 to close the volume of material 10 into the closed formation, insulated material is compressed together so as to form a seal to block drafts of air, as will be discussed further in conjunction with FIG. 7A et al.

The sliding fastener 110 comprises multiple tracks, each track comprising a pair of matable rows that preferably comprise zipper teeth. The sliding fastener 110 also comprises a slider slidably coupled to the rows for transforming the volume of material 10 between alternative configurations or formations. The slider accomplishes this transformation by fastening one of the pair of rows together while simultaneously unfastening another of the pair of rows, thereby causing the rows to preferably interchange. Examples of sliding fasteners, tracks, rows, and sliders will be described further herein.

The rows, whether or not they comprise zipper teeth, can be made of any type of material, including metal, plastic, and nylon, and can have any variety of shapes, weights, and lengths. In addition, the sliding fastener 110 can have any number of rows or tracks, and the rows need not be physically completely separate from each other—for example, two rows could comprise both ends of a long continuous row that has been bent in the middle so as to form the shape of a "U."

In some embodiments of the present invention, the slider of the sliding fastener 110 is irremovably coupled to the tracks in that the slider is not designed to be completely removed by the user from any of the rows, unlike with some standard zippers found on jackets, for example (wherein a standard zipper slider is detachable from one row of zipper teeth at the bottom of the jacket in order to allow a person wearing the jacket to remove the jacket or otherwise wear it open). However, some embodiments of the present invention contemplate a slider that can indeed be removed from one or more of the rows, some of the rows of which might include a standard zipper pin at one end (well known in the art), the zipper pin being designed to be manually insertable into a standard zipper box (also well known in the art) that is fixed to one end of a row.

Figure 2:
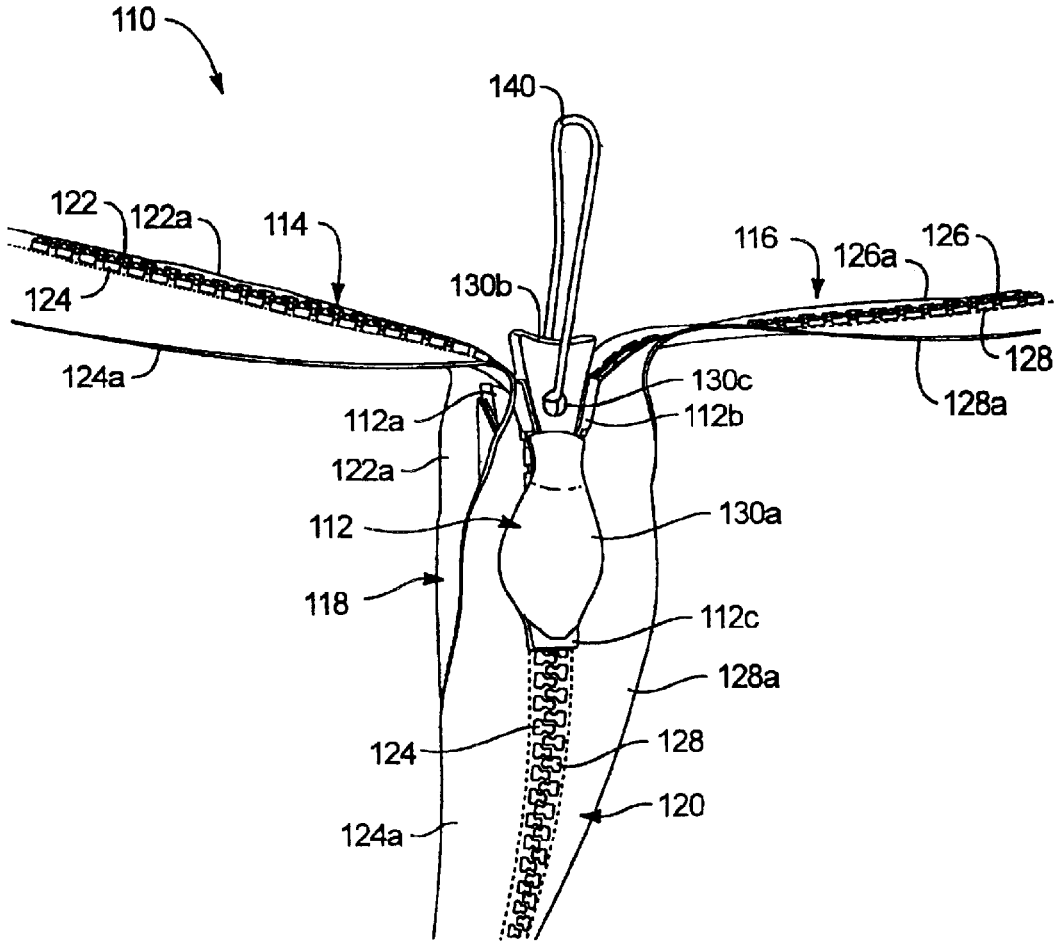
FIG. 2 is a perspective view showing one embodiment of a sliding fastener of the present invention.
Figure 3:
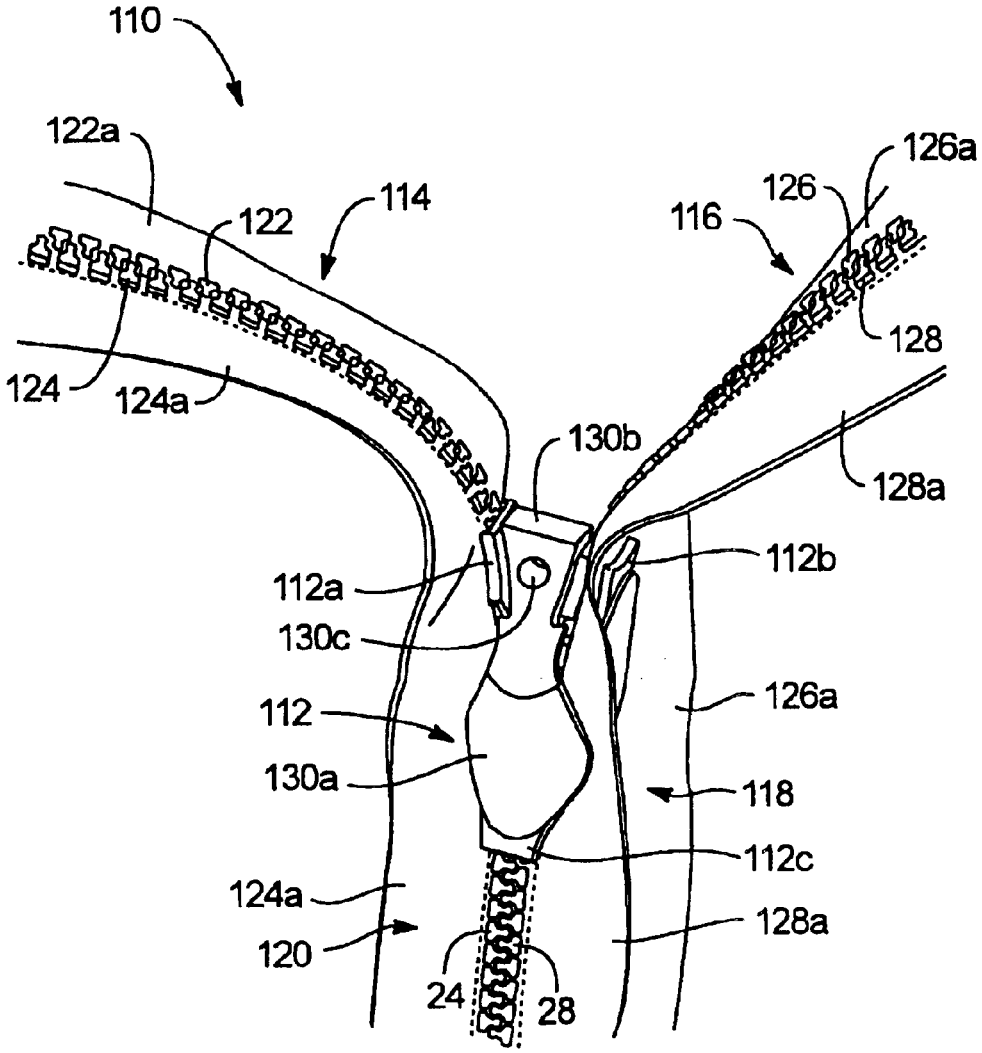
FIG. 3 is another perspective view of an embodiment of a sliding fastener.

FIGS. 2 and 3 show perspective views of one embodiment of the sliding fastener 110. This sliding fastener 110 basically comprises a first track 114, a second track 116, and a central slider 112. First track 114 comprises two rows 122 and 124, here shown as zipper teeth, that are matable with each other. Second track 116 also comprises two matable rows 126 and 128, here also shown as zipper teeth. The tracks 114 and 116 are coupled to the volume of material 10 via strips of tape or other connector material (that is, anything serving to directly connect the rows to the volume of material 10) 122*a*, 124*a*, 126*a*, and 128*a* extending from each side of the rows. Preferably, the rows 122, 124, 126, and 128 each comprise a row of teeth that interlock with each other as shown in FIGS. 2 and 3.

Figure 4:
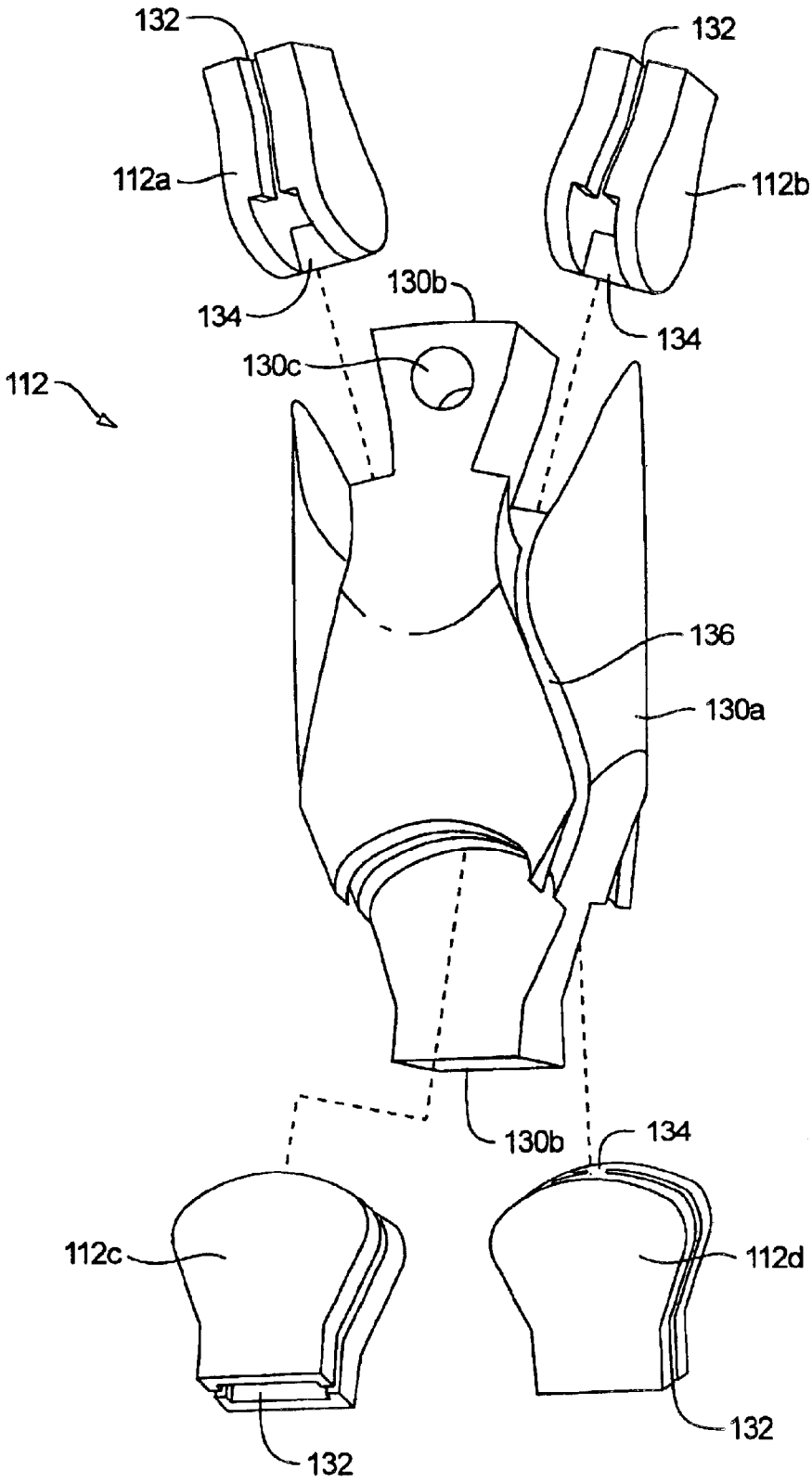
FIG. 4 is an exploded perspective view of one embodiment of a central slider of a sliding fastener of the present invention.

Central slider 112 is one embodiment of a slider comprising various parts, including slider parts 112*a* through 112*d* (an example of which can be seen best in FIG. 4). Central slider 112 closes or mates some of the rows together when it is slid along the tracks. Central slider 112 can also open or disengage some of the rows from each other when the central slider 112 is slid along the tracks.

When this central slider 112 is propelled along the tracks, the rows of the tracks interchange. For example, as can be seen in FIGS. 2 and 3, the rows 122, 124, 126, and 128 of the two tracks 114 and 116 interchange so as to re-form into tracks 118 and 120. At the top of FIGS. 2 and 3, it can be seen that track 114 comprises the mated rows 122 and 124, and track 116 comprises the mated rows 126 and 128.

FIGS. 2 through 4 show that the central slider 112 includes a contour or outer surface 130*a* that is preferably tapered or curved so as to allow a user to easily grasp the sides of the surface 130*a* and thereby either push or pull on the central slider 112 to propel the central slider 112 along the tracks. Outer surface 130*a* preferably includes one or more ends 130*b* upon which the user may push to propel the central slider 112 along the tracks. Note that in some embodiments, as in that shown in FIG. 2, end 130*b* extends out from the central slider 112. In other embodiments, as in that shown in FIGS. 3 and 6B, end 130*b* sits closer in with the rest of the central slider 112 (in FIG. 6B, the embodiment of the end 130*b* located at the left end of the central slider 112 has a curved indentation to more easily accommodate the user's finger when the user pushes against the end 130*b* to propel the central slider 112). A hole 130*c* can be optionally placed in central slider 112 to accommodate a pull cord 140 (see FIG. 2) that further facilitates the user's ability to propel the central slider 112 along the tracks.

Whether the central slider 112 is propelled by pushing or pulling on surface 130*a* or by tugging on pull cord 140, the means for propelling the central slider 112 preferably involves symmetrically balanced pressure exerted by the user upon the central slider 112. In other words, the sum of the user's vector forces exerted on the propulsion means preferably equals a vector force that aligns with the direction of desired movement of the central slider 112 along the tracks. Note that a typical pull tab located on only one side of the central slider 112 would cause the central slider 112 to lean in one direction when the pull tab is pulled; such a propulsion means is not symmetrically balanced.

Figure 6A:
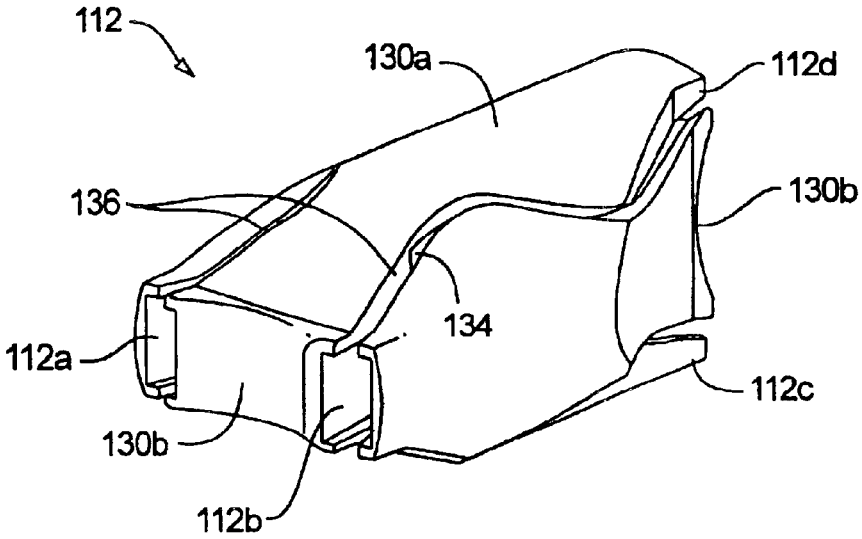
FIG. 6A is a perspective view of another embodiment of a central slider of a sliding fastener of the present invention.
Figure 6B:
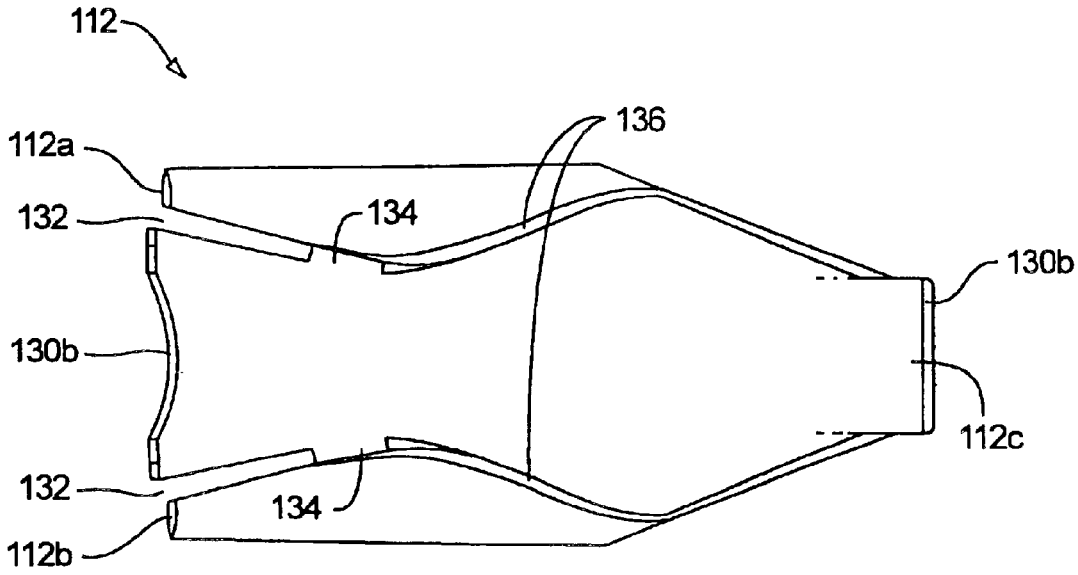
FIG. 6B is a side plan view of the embodiment shown in FIG. 6A.

During the assembly process of some embodiments of the central slider 112, the slider parts 112*a* through 112*d* are placed into the body of the central slider 112. The slider parts 112*a* through 112*d* may be insert molded, injection molded, snapped in, sonic welded, or otherwise coupled to the central slider 112. Some embodiments of the central slider 112, such as those shown in FIGS. 6A and 6B, are made of one integral piece that is formed, for example, by using a single mould.

Central slider 112 can be made of any sort of strong material, including stainless steel and plastic. In some embodiments, central slider 112 is made entirely of aluminum and is substantially hollow, such as the embodiment shown in FIG. 4 which generally resembles a substantially hollow cylinder. A substantially hollow central slider 112 enjoys the added advantage of being lightweight.

FIG. 4 is an exploded perspective view of an embodiment of a central slider 112 having slider parts 112*a* through 112*d* that enable the tracks 114, 116, 118, and 120 to enter and exit the central slider 112 at openings 132 so that the rows are in a closed, zipped-up, or mated state. The slider parts 112*a* through 112*d* cause the mated rows to disengage, preferably via a wedge 134 inside each of paths 136 (described in the next paragraph), in preparation for the row interchange to take place via the paths 136 inside the central slider 112. It will be noted that in the preferred embodiments of the present invention, openings 132 are angled so as to cause the rows to begin to rotate before the rows start to disconnect from each other (via the wedges 134) in preparation for interchange. However, some embodiments of the present invention also contemplate that the openings 132 need not be angled as such.

Central slider 112 includes paths 136 in which the tracks travel, causing the rows of the tracks to interchange as previously described. Paths 136 begin at the slider parts 112*a* through 112*d*, each of which preferably have openings 132 that are angled (for example, at the angle between vertical and the dotted line pointing to slider part 112*b* in FIG. 4) to facilitate the movement of the central slider 112 along the tracks (or, in other words, the movement of the tracks through the central slider 112). Additional preferred features that aid in such movement include: paths 136 that have gradual curves, ideally comprising a flattened or elongated helical shape such as the paths 136 shown in FIGS. 4 through 6B; paths 136 that run substantially through the outer portions of the central slider 112 (again like those shown in FIGS. 4 through 6B), as opposed to through the central cross section of the central slider 112; and paths 136 that are designed so as to allow at least a portion of the tape 122*a*, 124*a*, 126*a*, and 128*a* to move within the paths 136 along with their respective rows. In some embodiments, some or all of these preferred features that aid in moving the central slider 112 along the tracks, together allow the user to pull at the volume of material 10 coupled to the tapes 122*a*, 124*a*, 126*a*, and 128*a* and thereby conveniently propel the central slider 112 along the tracks without having to touch the central slider 112 as further described in the next paragraph. Also, in some embodiments of the present invention, these motion-aiding features serve to prevent or minimize the bunching of the volume of material 10 coupled to the tracks.

In some embodiments wherein the user need not touch the central slider 112 in order to propel it along the tracks, the user can propel the central slider 112 by pulling the sections of the volume of material 10 located on each side of the tracks away from each other. In other words, the user can cause the central slider 112 to propel along the tracks and transform the volume of material 10 without even having to touch the central slider 112 or any extension thereon. In the preferred embodiments, angled openings 132 in the central slider 112 help facilitate this ability to propel the central slider 112 without touching it.

Figure 5A:
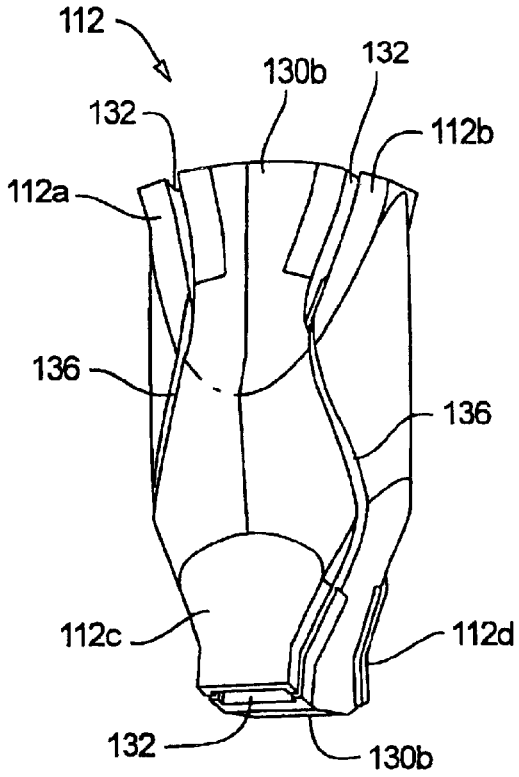
FIGS. 5A through 5C are perspective views of one embodiment of a central slider of a sliding fastener of the present invention.
Figure 5B:
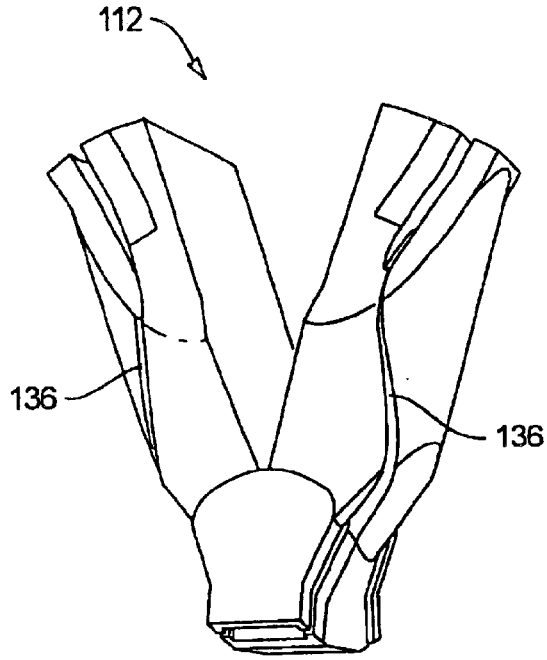
Figure 5C:
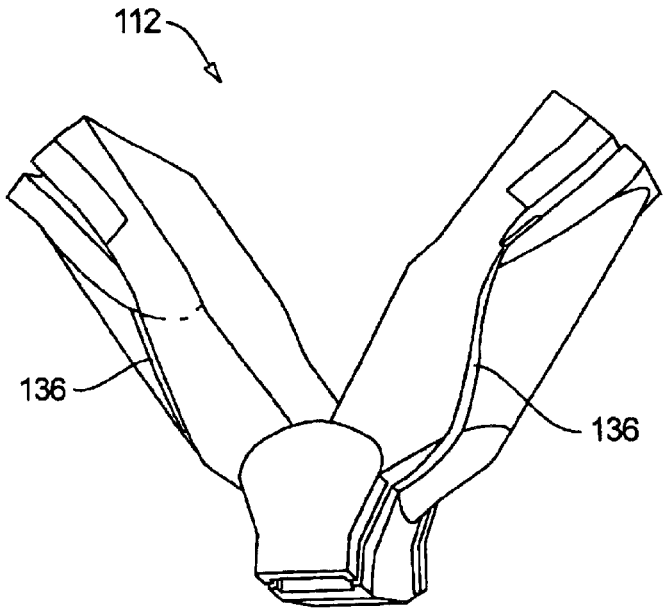

FIG. 5A shows one embodiment of the central slider 112 that has the capability of flaring outwardly by splitting partially apart, as shown in the progression from FIGS. 5A to 5C, when the volume of material 10 near the central slider 112 is pulled at. This flaring capability further facilitates the ability of the central slider 112 to move along the tracks, which, in turn makes it easier for the user to propel the central slider 112 along the tracks without using his hands. Note that the embodiment of the central slider 112 shown in FIGS. 5A through 5C show an example of a central slider 112 that is substantially solid.

Figure 7B:
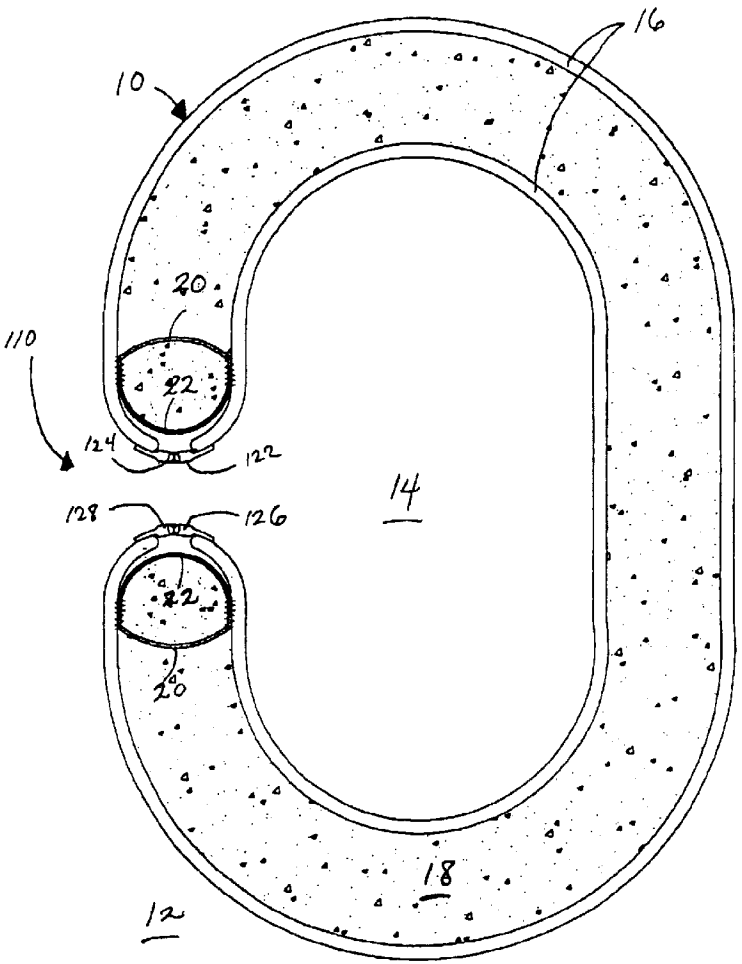
FIG. 7B is a cross section taken from lines 7B—7B in FIG. 1B.
Figure 7A:
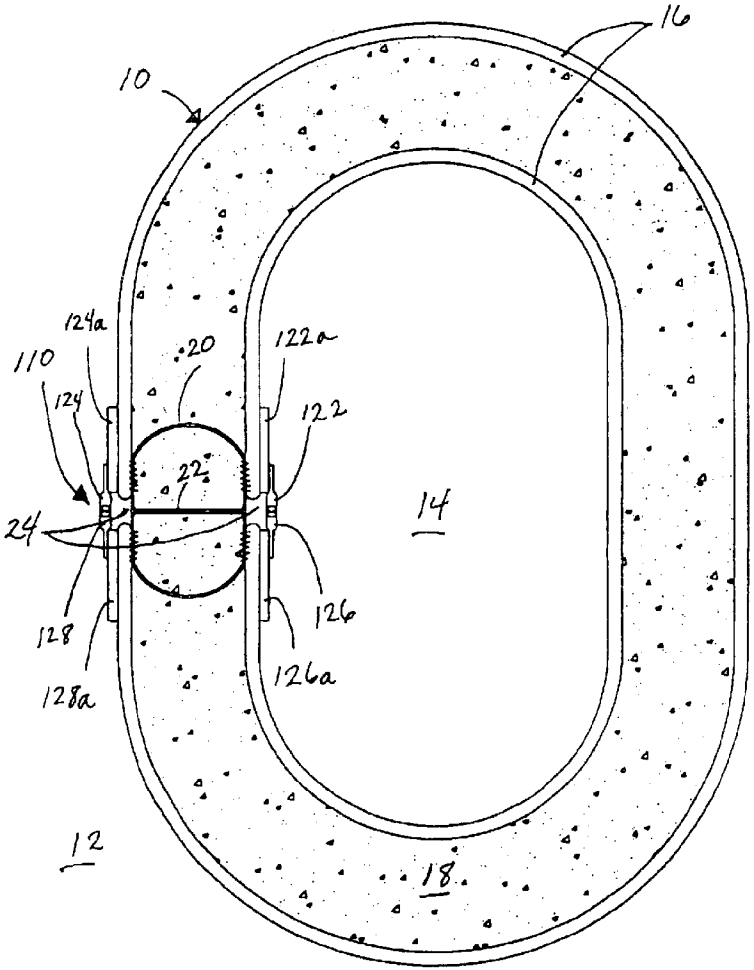
FIG. 7A is a cross section taken from lines 7A—7A in FIG. 1A.

FIG. 7A shows a cross section of one embodiment of the volume of material 10 in the closed position, the cross section being taken at lines 7A—7A in FIG. 1A. In this embodiment, an outer shell 16 comprises the outer part of the volume of material 10. Here, it can be seen that the outer shell 16 comprises both an interior portion adjacent to the interior 14, as well as an exterior portion adjacent to the exterior 12. Insulation 18 is placed within the outer shell 16; however, in some embodiments, the insulation 18 and outer shell 16 are not separate parts but are integrally formed from the same material.

Figure 7C:
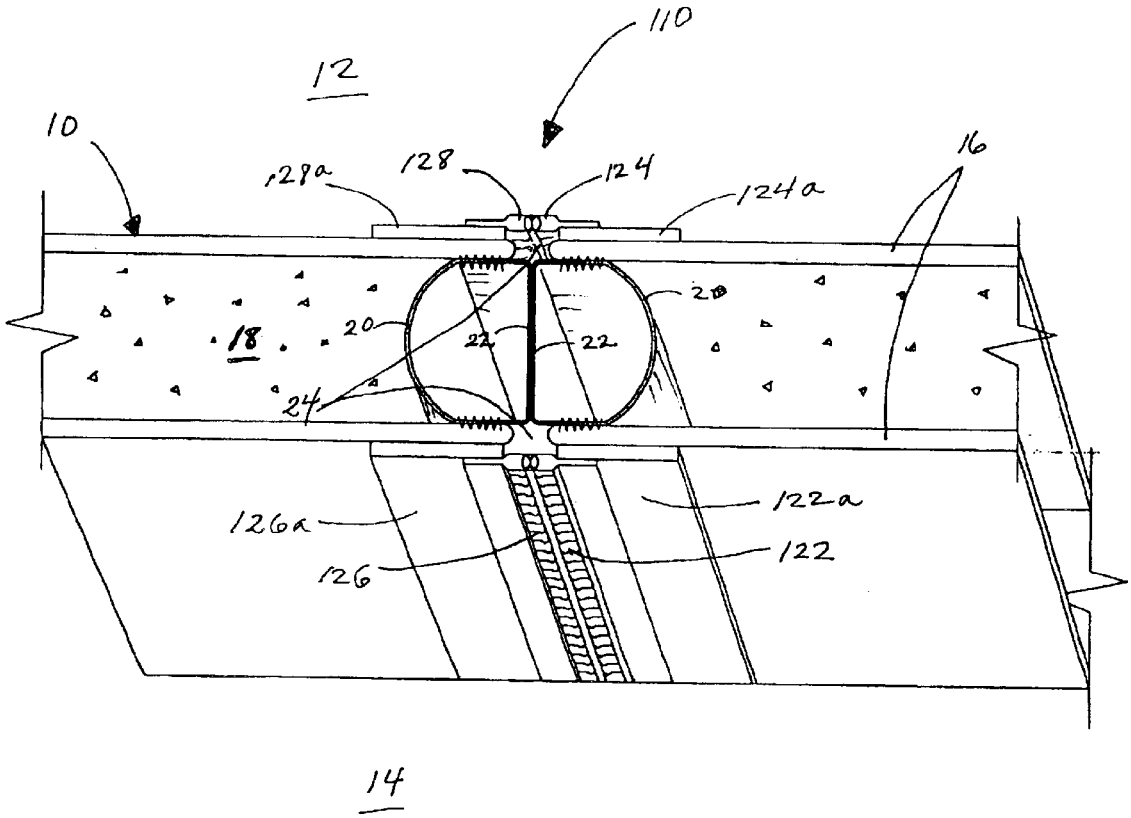
FIG. 7C is a partial perspective view of FIG. 7A.

In the embodiment shown in FIG. 7A, within the outer shell 16 is a first wall 20 and a second wall 22. Walls 20 and 22 together comprise a tube in which insulation 18 is enclosed, the tube preferably lying adjacent to and along the length of the sliding fastener 110. The enclosed insulation 18 may be either the same as or different than that found within the rest of the outer shell 16. When a user slides the sliding fastener 110 to close the volume of material 10 into the closed position, each of the tubes in this embodiment are thereby automatically compressed together to form a seal. This seal helps prevent drafts of air from traveling between the interior 14 and exterior 12 through spaces 24. Preferably, wall 20 is made of flexible material, and wall 22 of relatively rigid material—this is to help the each of the tubes to seal properly and to avoid becoming stuck in any adjacent zipper teeth or against any other nearby parts. FIG. 7B shows a similar cross section to that in FIG. 7A, except FIG. 7B shows the volume of material 10 in the open position. FIG. 7C is a partial perspective view of FIG. 7A; note that FIG. 7C does not show insulation 18 inside of the tubes.

Figure 8A:
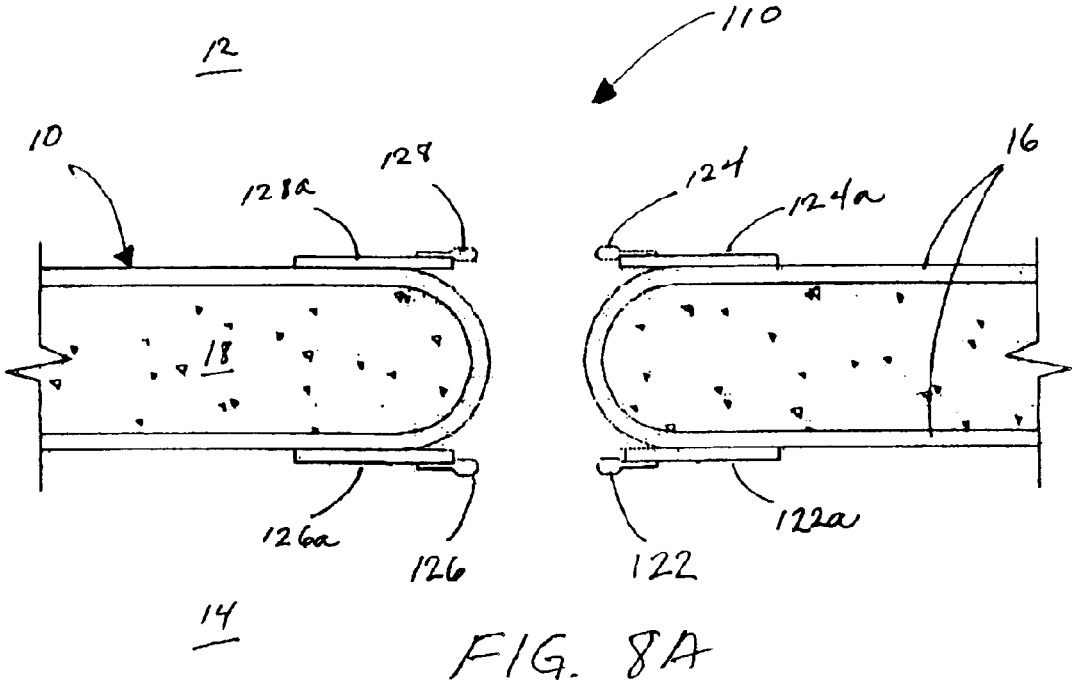
FIG. 8A is a view similar to that of FIG. 7B, except that FIG. 8A shows only a partial view and shows a different embodiment of the present invention.

FIG. 8A shows another embodiment of the present invention having a different sliding fastener 110 from that shown in FIGS. 7A and 7B. Note that FIG. 8A is a view similar to that of FIG. 7B, except that FIG. 8A shows only a partial view of the volume of material 10. The rows 122, 124, 126, and 128 of the sliding fastener 110 illustrated in FIG. 8A do not interchange; rows 122 and 126 are designed to mate with only each other, and rows 124 and 128 are designed to mate with only each other. In this embodiment, the central slider 112 (not shown in FIGS. 8A and 8B) basically comprises two standard zipper sliders, one for each matable pair of rows. The two standard zipper sliders are fixedly connected so that they always move simultaneously up and down their respective rows. Note that, in this embodiment, the insulation 18 is exposed to the environment 12 when the volume of material 10 is in the open formation.

Figure 8B:
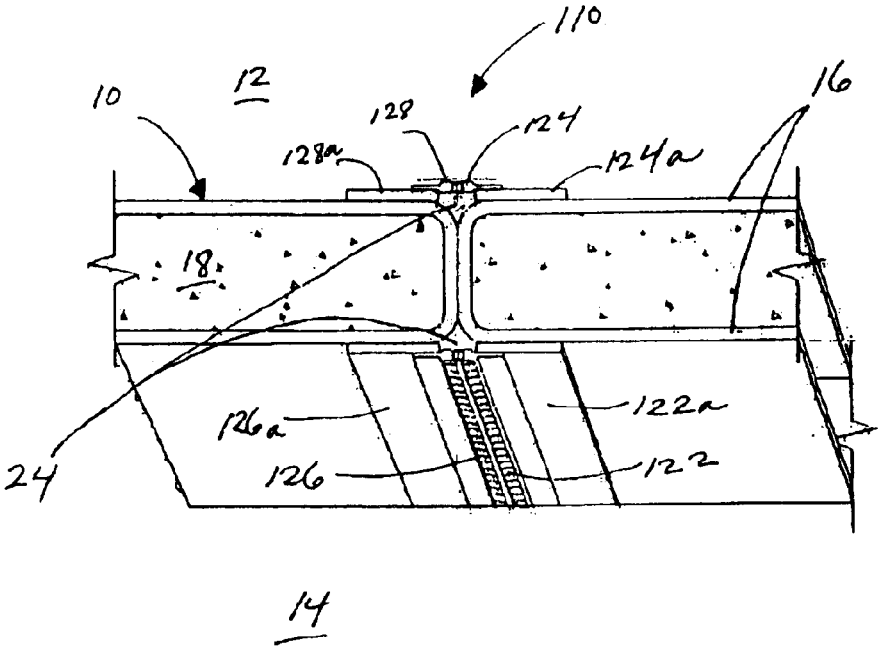
FIG. 8B is partial perspective view of FIG. 8A, except that FIG. 8B shows the volume of material in the closed position.

FIG. 8B is partial perspective view of FIG. 8A, except that FIG. 8B shows the volume of material 10 in the closed position. As can be seen in FIG. 8B, this embodiment operates by compressing together two sides of the outer shell 16 to create a seal. Also, in this embodiment, there is no tube to separately enclose the insulation 18 to be compressed.

In summary, the present invention provides a convenient system for preventing drafts of air from entering through a closed fastener in a volume of material. Some embodiments of the present invention provide a substantially air-tight sleeping bag, despite the use of zippers in the bag. The various embodiments of the present invention provide unparalleled flexibility, versatility, and convenience to the user.

It should be emphasized that the present invention, and particularly the type of sliding fastener used in the present invention, is not limited to the specific examples described in this Detailed Description. For example, in some embodiments, the thickness of the insulation 18 may vary depending on the size of the sliding fastener. In other embodiments, one end of the central slider 112 may be wedge-shaped so as to facilitate fastening and unfastening. Also, various parts of the present invention may be made of a variety of materials and be made into any shape that will accomplish the functions of the present invention. Any two or more of the various elements of the present invention may be manufactured as a single whole part instead of as pieces manufactured separately and then subsequently coupled together.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

a volume of material having a first closed formation wherein the volume of material encloses an interior of the volume of material, and a second open formation wherein said interior is exposed to the environment exterior to the volume of material;

a sliding fastener coupled to the volume of material, the sliding fastener allowing a user to selectively alternate the volume of material between said open and closed formations; and insulation, coupled to said volume of material, that compresses together to form a seal when said sliding fastener closes said volume of material into the closed formation, wherein the seal helps prevent air from moving between said interior and the environment through the sliding fastener.

2. The system of claim 1 wherein said sliding fastener comprises:

a plurality of tracks, each track comprising a pair of matable rows; and a slider slidably coupled to the rows, wherein the movement of the slider along the rows causes the rows to interchange with each other.

3. The system of claim 2 further comprising means for propelling the slider along the tracks.

4. The system of claim 2 wherein said slider can split partially apart to facilitate movement of the slider along the tracks.

5. The system of claim 2 wherein the slider has a curved contour upon which the user may push and pull in order to propel the slider along the matable rows.

6. The system of claim 2 wherein said slider comprises a central slider comprising:

a first end and a second end, an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange.

7. The system of claim 1 wherein said sliding fastener comprises:

a plurality of tracks, each track comprising a pair of matable rows; and a slider slidably coupled to the rows, wherein the movement of the slider along the rows causes one of the pair of rows to fasten together while simultaneously unfastening another of the pair of rows.

8. The system of claim 1 wherein said volume of material comprises a sleeping bag.

9. The system of claim 1 wherein said volume of material comprises a jacket.

10. The system of claim 1 wherein said sliding fastener comprises zipper teeth.

11. The system of claim 1 wherein said volume of material further comprises an outer shell and an insulation-filled tube located within the outer shell and adjacent to the sliding fastener.

12. The system of claim 11 wherein said tube comprises a first wall and a second wall, the first wall comprising rigid material, and the second wall comprising flexible material.

13. A system comprising:

a volume of material having an exterior outer shell, an interior outer shell, a first closed formation wherein the volume of material encloses an interior of the volume of material, and a second open formation wherein said interior is exposed to the environment exterior to the volume of material;

a sliding fastener coupled to the volume of material, the sliding fastener allowing a user to selectively alternate the volume of material between said open and closed formations, the sliding fastener comprising:

a plurality of tracks, each track comprising a pair of matable rows, two of the matable rows being coupled to the exterior outer shell, and two of the matable rows being coupled to the interior outer shell; and a slider slidably coupled to the rows, the slider fastening the matable rows coupled to said exterior outer shell while simultaneously unfastening the matable rows coupled to said interior outer shell; and insulation, coupled to said volume of material, that compresses together to form a seal when said sliding fastener closes said volume of material into the closed formation, wherein the seal helps prevent air from moving between said interior and the environment through the sliding fastener.

14. The system of claim 13 wherein said wherein the movement of said slider along the rows causes the rows to interchange with each other.

15. The system of claim 13 wherein said slider comprises a central slider comprising:

a first end and a second end;

an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange, said central slider being shaped so that the rotation of the tracks within said central slider begins while the rows are being disconnected from each other in preparation for said interchange.

16. The system of claim 13 wherein said insulation is exposed to the environment when the volume of material is in the open formation.

17. The system of claim 13 wherein said volume of material comprises a sleeping bag.

18. The system of claim 13 wherein said volume of material comprises a jacket.

19. The system of claim 13 wherein said volume of material further comprises an outer shell and an insulation-filled tube located within the outer shell and adjacent to the sliding fastener.

20. A system comprising:

a volume of material, a first closed formation wherein the volume of material encloses an interior of the volume of material, and a second open formation wherein said interior is exposed to the environment exterior to the volume of material;

means for selectively alternating the volume of material between said open and closed formations; and means for preventing air from moving between said interior and the environment through said means for selectively alternating.

* * * * *